US005687924A

United States Patent [19]

Reiche et al.

[11] Patent Number: 5,687,924

[45] Date of Patent: Nov. 18, 1997

[54] FLEXIBLE PLASTIC APPARATUS FOR STORING EMBROIDERY FLOSS

[76] Inventors: Kathryn Louise Reiche; Gerald Miles Reiche, both of 8521 International Ave. #207, Canoga Park, Calif. 91304

[21] Appl. No.: 188,710

[22] Filed: May 17, 1994

[51] Int. Cl.[6] ..... B65H 49/30; B65H 54/56; B65H 54/46

[52] U.S. Cl. ..... 242/127; 206/388; 206/49; 242/50; 242/53

[58] Field of Search ..... 242/127, 128, 242/129, 571, 571.8, 53, 50; 68/149, 206; 206/388, 49, 63.5, 495

[56] References Cited

U.S. PATENT DOCUMENTS

| | | | |
|---|---|---|---|
| Re. 6,751 | 11/1875 | Sutro | 242/53 X |
| 1,388,561 | 8/1921 | Grote | 206/388 |
| 2,558,386 | 6/1951 | Rabinowitz | 242/127 |
| 3,627,120 | 12/1971 | Bordeau | 206/388 |
| 3,833,183 | 9/1974 | Swatzell, Jr. | 242/127 |
| 4,421,231 | 12/1983 | McCarn | 206/388 |
| 4,494,653 | 1/1985 | Praderio | 206/388 X |

*Primary Examiner*—Michael Mansen

*Attorney, Agent, or Firm*—Thomas I. Rozsa; Tony D. Chen

[57] ABSTRACT

The apparatus includes a memory which enables the apparatus to return to its manufactured form following the mounting of the embroidery floss skein. The apparatus length is perfectly suited for the mounting of the embroidery floss skein in it's retail form. The apparatus contains two projections on which the looped ends of the embroidery floss skein are placed thereby eliminating the need to disassemble the embroidery floss skein for manual wrapping around the storage unit. The apparatus contains slots designed to, store the endings of the embroidery floss skeins thereby preventing unraveling of the floss. The apparatus contains slots at the top and which are designed to store the embroidery floss which has been cut and separated from the main part of the embroidery floss skein.

14 Claims, 1 Drawing Sheet

FLEXIBLE PLASTIC APPARATUS FOR STORING EMBROIDERY FLOSS

BACKGROUND OF THE INVENTION

1. Field of the Invention

The present invention relates to the use and storage of embroidery floss. Primarily, this will be utilized by those involved in the craft industry such as cross-stitchers, quilt makers, and the like. It will enable those who utilize embroidery floss to store an entire skein in the same form as provided by the manufacturer to retailer without change. It will also enable those who utilize embroidery floss to store unused portions of the floss with ease.

2. Description of the Prior Art

The prior art utilizes a single square piece of plastic for the storage of embroidery floss. The flaw in this design is that it requires the disassembly of the embroidery floss skein into one long piece of floss which must then be wrapped manually around the plastic piece. This is time consuming and can result in knotting and fraying of the floss.

Secondarily, the prior art cannot store used portions of the floss which have been cut from the remainder of the floss and separated for use.

Third, the prior art provides no effective means of color coding the more than 365 different embroidery floss colors that are available on the market.

SUMMARY OF THE INVENTION

The present invention is designed to fit the embroidery floss skein without disassembly. One simply loops one end of the skein over the projection at the base of the invention, bends the top of the invention slightly, then loops the remaining end of the skein over the projection at the top end of the invention, and then allows the invention to return to it's unbent state.

The current invention also permits storage of these pieces by wrapping them around the slots found at the top end of the invention.

The present invention also permits utilization of the color code that accompanies each embroidery floss skein either by taping the color code strip on to the base of the invention or by utilizing permanent marker to write directly on the invention.

BRIEF DESCRIPTION OF THE DRAWING

The present invention will be more fully understood by reference to the following detailed description thereof when read in conjunction with the attached drawing, and wherein.

DETAILED DESCRIPTION OF THE DRAWING

Figure 1:
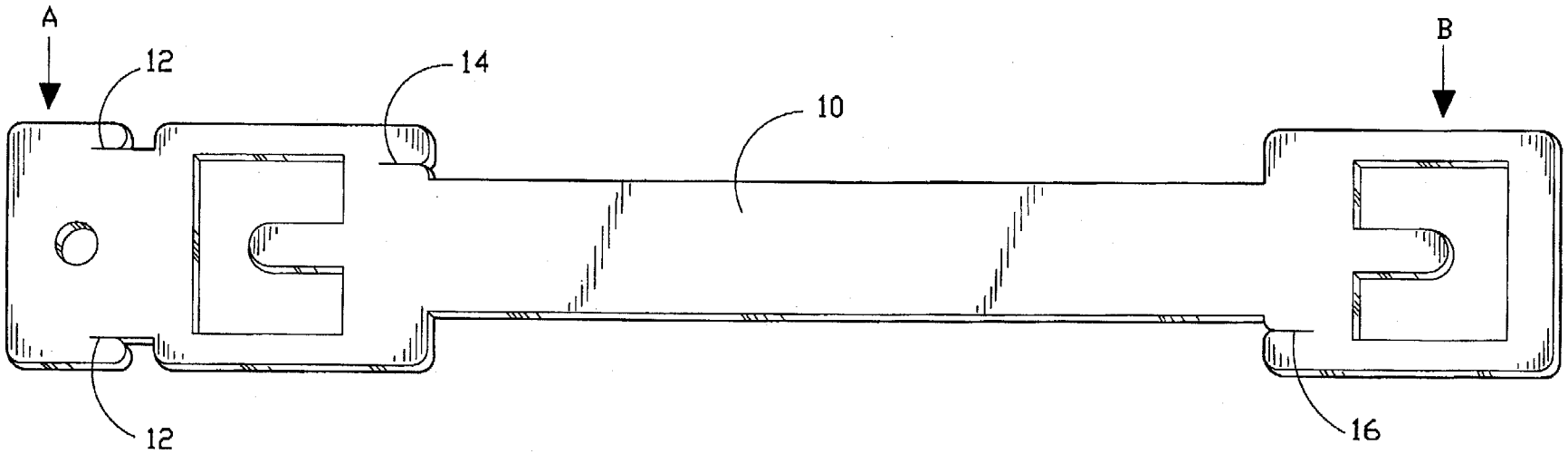
FIG. 1 is an overhead view of a preferred embodiment of the flexible plastic apparatus of the present invention.

The present invention is a single unit with no moving parts, other than it's inherent flexibility. It is made of a flexible plastic with enough memory to return to it's original flat unbent form. It is 8⅞ inches long, 3/32 inches thick, 1⅜ inches wide at each end, and ¾ inches wide at it's center. Each outer corner is slightly rounded. (See FIG. 1) The two ends are not identical; end "A" is known as the top and end "B" is know as the bottom. Approximately ¼ inches from the center of the top is a hole ¼ inch in diameter. The outer edges of end A mirror each other in that ⅝ inches from the top of each outer edge a square measuring ⅛ inch is cut from each side. Each inside edge of this square, parallel with the length of the present invention, are cuts up into the top 7/32 inches in length creating a slot 12 on each side 2⅜ inches from the top, each outer edge indents 5/16 inches. This indentation continues down the piece until it is 9/16 inches from the bottom, where it then returns to the widest measurement of 1⅜ inches. At the top right and bottom left side of this narrow strip 10 are two additional slots 14 and 16 running parallel to the length of the present invention, and measuring 5/16 inches long (See FIG. 1).

DESCRIPTION OF MANUFACTURE AND USE

The present invention is manufacturer through the use of a two part metal injection mold which is water cooled. The piece is hand trimmed. The raised trademark lettering is engraved on one side of the mold. All other cuts and details are tooled in the other half of the mold.

The present invention is used as follows: Take the embroidery floss skein that has been obtained from the manufacturer, remove the paper sleeves encasing the skein, place one end of the skein over the projection located at the bottom (B) of the present invention, bend the top portion of the present invention forward until the remaining end of the embroidery floss skein can be placed over the projection located at the top end (A) of the present invention, place the remaining end of the embroidery floss skein over the projection located at the top end (A) of the present invention, allow the invention to it's original shape, tuck the starter "tail" in the nearest slot (at either end of the present invention) to prevent unraveling, either tape the previously removed sleeve containing the color code of the floss to the present invention or using a permanent marker write the color code on the bottom end (B) of the present invention. Remove the starter "tail" from the slot, unwrap the embroidery floss, cut the length of floss desired from the skein, tack the remaining started "tail" back into the nearest slot. Separate the embroidery floss into the desired number of strands from the cut length of embroidery floss, wrap the unused strands around the top niche located at the top (A) end of the present invention hooking the beginning end and ending end into the two slots located on either side of the top (A).

We claim:

1. An apparatus for storing and retaining an embroidery floss skein without modifying the embroidery floss skein, the apparatus comprising:

a. an elongated flexible narrow strip member having a top portion with a top end, a middle portion and a bottom portion with a bottom end, the top portion having a square shaped cutout with a projection extending towards the top end and first and second opposite exterior edge slots located adjacent to the top end and the square shaped cutout, the bottom portion having a square shaped cutout with a projection extending towards the bottom end, the top and bottom portions being larger in width than the middle portion;

b. a third exterior edge slot located on said top portion and located adjacent to one end of said middle portion for latching one end of said embroidery floss skein;

c. a fourth exterior edge slot alternatively offset and opposite from said third exterior edge slot and located on said bottom portion and adjacent to the other end of said middle portion for latching the other end of said embroidery floss skein; and d. said embroidery floss skein looped over said projection of said bottom portion, and said top portion being flexible such that said top portion can be bent forward until the opposite side of said embroidery floss skein is looped over said projection of said top portion, and that said top portion can be released to return to its normal unbent condition for storing and retaining said embroidery floss skein.

2. The apparatus in accordance with claim 1 wherein said top portion includes a central hole therethrough for hooking and storing said flexible narrow strip member.

3. The apparatus in accordance with claim 1 wherein said top and bottom ends further comprises rounded edges.

4. An apparatus for storing and retaining an embroidery floss skein without modifying the embroidery floss skein, the apparatus comprising:

a. a flexible strip member having a top portion, a middle portion and a bottom portion, the top and bottom portions each having a cutout with a projection extending away from the middle portion;

b. a first edge slot located on said top portion and located adjacent to one end of said middle portion for latching one end of said embroidery floss skein;

c. a second edge slot alternatively offset and opposite from said first edge slot and located on said bottom portion and adjacent to the other end of said middle portion for latching the other end of said embroidery floss skein; and d. said embroidery floss skein looped over said projection of said bottom portion, and said top portion being flexible such that it can be bent forward until the opposite side of said embroidery floss skein is looped over said projection of said top portion, and that said top portion can be released to return to its normal unbent condition for storing and retaining said embroidery floss skein.

5. The apparatus in accordance with claim 4 wherein said top portion includes a central hole therethrough for hooking and storing said flexible strip member.

6. The apparatus in accordance with claim 4 wherein said top-and bottom portions are larger in width than said middle portion.

7. The apparatus in accordance with claim 4 further comprising third and fourth opposite edge slots located on said top portion and remote from said middle portion.

8. An apparatus for storing and retaining an embroidery floss skein, comprising: a strip member having a top portion, a middle portion and a bottom portion, the top and bottom portions each having a cutout with a projection extending away from the middle portion said embroidery floss skein looped over said projection of said bottom portion, and said top portion being flexible such that it can be bent forward until the opposite side of said embroidery floss skein is looped over said projection of said top portion, and that said top portion can be released to return to its normal unbent condition for storing and retaining said embroidery floss skein.

9. The apparatus in accordance with claim 8 wherein said top portion includes a central hole therethrough for hooking and storing said strip member.

10. The apparatus in accordance with claim, 8 further comprising means for latching one end of said embroidery floss skein.

11. The apparatus in accordance with claim 10 wherein said means includes a first edge slot located on said top portion.

12. The apparatus in accordance with claim 11 wherein said means includes a second edge slot located on said bottom portion and opposite said first edge slot.

13. The apparatus in accordance with claim 8 further comprising means for latching the other end of said embroidery floss skein.

14. The apparatus in accordance with claim 8 further comprising third and fourth edge slots located on said top portion and remote from said middle portion.

* * * * *